US009142896B2

(12) United States Patent
Wickes et al.

(10) Patent No.: US 9,142,896 B2
(45) Date of Patent: Sep. 22, 2015

(54) CONNECTOR ASSEMBLIES HAVING PIN SPACERS WITH LUGS

(71) Applicant: Tyco Electronics Corporation, Berwyn, PA (US)

(72) Inventors: Evan Charles Wickes, Harrisburg, PA (US); Wayne Samual Davis, Harrisburg, PA (US); Kyle Gary Annis, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 33 days.

(21) Appl. No.: 14/081,385

(22) Filed: Nov. 15, 2013

(65) Prior Publication Data

US 2015/0140865 A1 May 21, 2015

(51) Int. Cl.

| | |
|---|---|
| ***H01R 13/44*** | (2006.01) |
| ***H01R 9/24*** | (2006.01) |
| ***H01R 13/6596*** | (2011.01) |
| ***H01R 13/639*** | (2006.01) |

(52) U.S. Cl.

CPC ..... *H01R 9/2408* (2013.01); *H01R 13/6397* (2013.01); *H01R 13/6596* (2013.01)

(58) Field of Classification Search

CPC .... H01R 13/6397; H01R 13/60; H01R 13/44; H01R 13/443

USPC ..... 439/133–148

See application file for complete search history.

(56) References Cited

U.S. PATENT DOCUMENTS

| | | | | |
|---|---|---|---|---|
| 5,348,488 | A * | 9/1994 | Green et al. | 439/140 |
| 5,692,912 | A | 12/1997 | Nelson et al. | |
| 6,494,724 | B1 | 12/2002 | Bixler et al. | |
| 6,638,104 | B2 * | 10/2003 | Hashimoto et al. | 439/567 |
| 6,755,691 | B2 * | 6/2004 | Sasame et al. | 439/607.27 |
| 6,923,662 | B2 * | 8/2005 | Sasame et al. | 439/79 |
| 7,267,515 | B2 * | 9/2007 | Lappohn | 439/607.07 |
| 7,690,946 | B2 | 4/2010 | Knaub et al. | |
| 7,927,143 | B2 | 4/2011 | Helster et al. | |
| 7,931,500 | B2 | 4/2011 | Knaub et al. | |

* cited by examiner

*Primary Examiner* — Chandrika Prasad

(57) ABSTRACT

A connector assembly includes a housing, a plurality of contact modules received in the housing, and a pin spacer coupled to the contact modules. Each contact module has a plurality of contacts each including a pin extending from a bottom of the corresponding contact module. The pin spacer has a plurality of pin holes extending through the pin spacer. The pin holes receive corresponding pins for mounting to the circuit board. The pin spacer holds relative positions of the pins. The pin spacer has side edges at opposite sides of the pin spacer and lugs extending from the top of the pin spacer proximate to the sides of the pin spacer. The lugs block entry into a space defined between the bottoms of the contact modules and the top of the pin spacer.

20 Claims, 8 Drawing Sheets

CONNECTOR ASSEMBLIES HAVING PIN SPACERS WITH LUGS

BACKGROUND OF THE INVENTION

The subject matter herein relates generally to pin spacers for connector assemblies.

Some electrical systems utilize electrical connectors, such as header assemblies and receptacle assemblies, to interconnect two circuit boards, such as a motherboard and daughtercard. The electrical connectors include contacts having pins extending from a mounting end of the electrical connectors. The pins are through-hole mounted to the circuit board by loading the pins into plated vias in the circuit board. The electrical connectors are typically pre-assembled and configured to be mounted to the circuit board. In order to insure that the pins are oriented correctly, many electrical connectors include pin spacers or pin organizers that are coupled to the bottoms of the electrical connectors and that hold the pins in proper positions for mounting to the circuit board.

The electrical connectors are typically shipped with the pin spacers in an intermediate position to support and protect the pins during shipping. Typically, many electrical connectors are shipped together in a shipping tube or container that holds the electrical connectors. However, during shipping, it is possible that the electrical connectors move within the shipping tube. For example, the electrical connectors may shift up, down or laterally side-to-side. When the electrical connectors shift, the pins are susceptible to damage, such as bending. For example, the pin spacer of one receptacle connector may overlap with the pin spacer of an adjacent electrical connector, causing the pins to bend.

A need remains for an improved pin spacer that is able to protect the pins during shipping and handling.

BRIEF DESCRIPTION OF THE INVENTION

In one embodiment, a connector assembly is provided that includes a housing, a plurality of contact modules received in the housing, and a pin spacer coupled to the contact modules. Each contact module has a plurality of contacts each including a pin for terminating to a circuit board. The pins extend from a bottom of the corresponding contact module. The pin spacer has a plurality of pin holes extending through the pin spacer between a top of the pin spacer and a bottom of the pin spacer. The pin holes receive corresponding pins for mounting to the circuit board. The pin spacer holds relative positions of the pins. The pin spacer has side edges at opposite sides of the pin spacer and lugs extending from the top of the pin spacer proximate to the sides of the pin spacer. The lugs block entry into a space defined between the bottoms of the contact modules and the top of the pin spacer.

Optionally, the lugs may prevent damage to the pins. The lugs may have exterior walls substantially aligned with the side edges of the pin spacer. The lugs may be interspersed with pin holes along the sides of the pin spacer. Optionally, the sides may be scalloped to internest with a pin spacer of an adjacent connector assembly.

Optionally, the pin spacer may be initially held spaced apart from the bottoms of the contact modules on the pins to define the space between the bottoms of the contact modules and the top of the pin spacer. The lugs may span across a majority of the space. The lugs may span entirely across the space to engage the contact modules.

Optionally, the lugs may block a pin spacer of an adjacent connector assembly from entering the space. The lugs may block lateral shifting of the pin spacer relative to a pin spacer of an adjacent connector assembly.

Optionally, the opposite sides may include a first side and a second side. The lugs along the first side may be staggered forward with respect to the lugs along the second side. The connector assembly may be positioned adjacent a second connector assembly. The lugs along the second side may be staggered with respect to lugs along a first side of the second connector assembly.

In a further embodiment, a connector assembly may be provided including a housing and contact modules coupled to the housing. Each contact module includes a conductive holder holding a frame assembly. The frame assembly includes a plurality of signal contacts and a dielectric frame supporting the signal contacts. The dielectric frame is received in the conductive holder. The signal contacts each include a signal pin for terminating to a circuit board. The signal pins extend from a bottom of the contact module. A ground shield is coupled to the conductive holder. The ground shield is electrically connected to the conductive holder. The ground shield has grounding pins extending beyond the bottom of the contact module for terminating to the circuit board. A pin spacer is coupled to the contact modules. The pin spacer has a plurality of signal pin holes and ground pin holes extending through the pin spacer between a top of the pin spacer and a bottom of the pin spacer. The signal pin holes receive corresponding signal pins and the ground pin holes receive corresponding grounding pins. The signal pins and grounding pins extend beyond the bottom of the pin spacer for mounting to the circuit board. The pin spacer holds relative positions of the signal pins and grounding pins. The pin spacer has side edges at opposite sides of the pin spacer. The pin spacer has lugs extending from the top of the pin spacer. The lugs block entry into a space defined between the bottoms of the contact modules and the top of the pin spacer.

In a further embodiment, a pin spacer is provided for a connector assembly having a plurality of pins extending from a bottom of the connector assembly. The pin spacer includes a plate having a top, a bottom, a front, a rear and opposite sides with edges extending between the top and bottom along the front, rear and sides. A plurality of pin holes extend through the plate between the top and bottom. The pin holes receive corresponding pins of the connector assembly. The pin holes are spaced apart in an array corresponding to a particular pinout of vias in a circuit board to which the connector assembly is mounted. Lugs extend from the top. The lugs are positioned proximate to the sides of the plate. The lugs block entry into a space defined above the top of the plate from the sides of the plate.

DETAILED DESCRIPTION OF THE INVENTION

Figure 1:
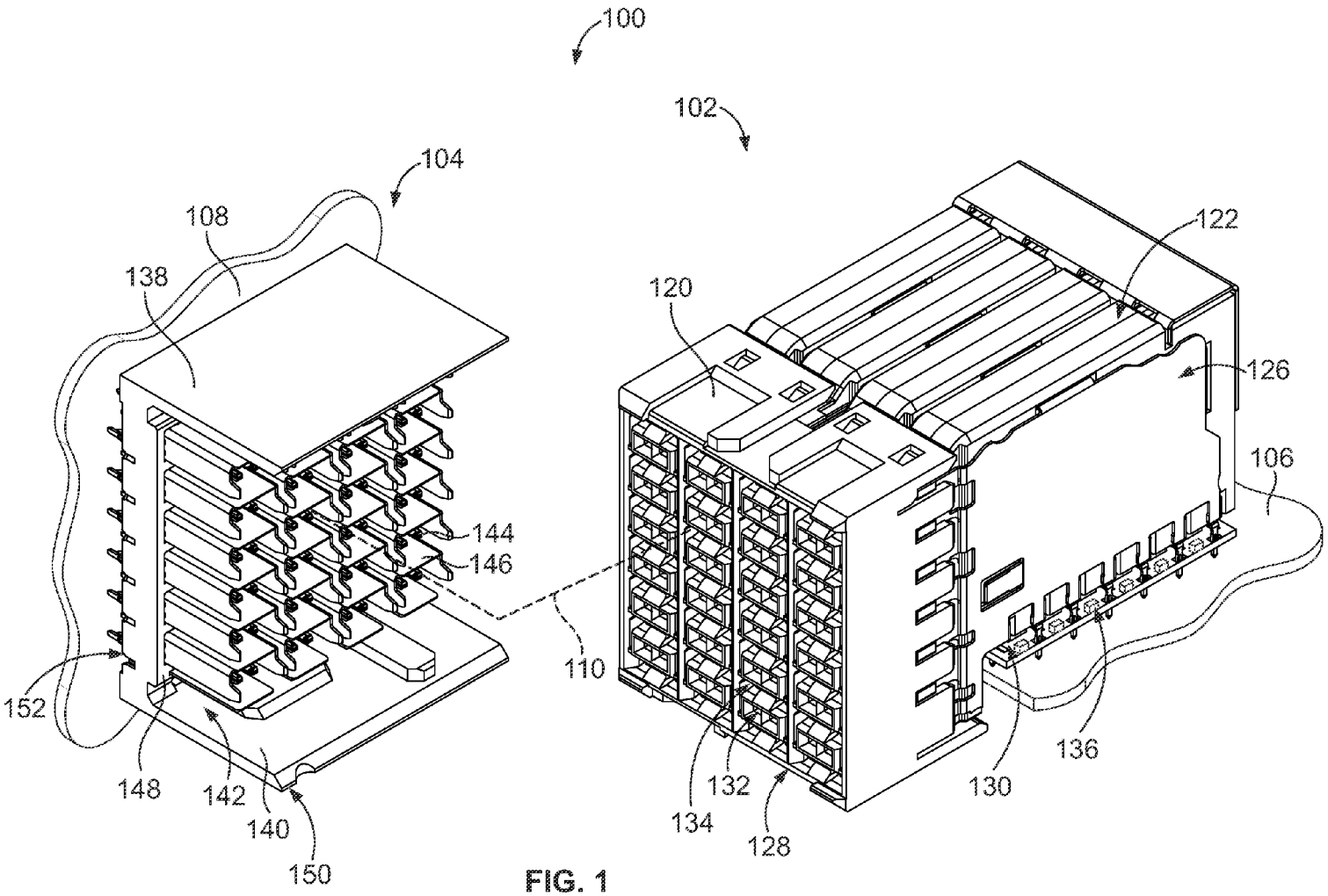
FIG. 1 is a perspective view of an electrical connector system formed in accordance with an exemplary embodiment.

FIG. 1 is a perspective view of an electrical connector system 100 formed in accordance with an exemplary embodiment. The connector system 100 includes first and second connector assemblies 102, 104. In the illustrated embodiment, the first connector assembly 102 is a receptacle assembly and may be referred to hereinafter as a receptacle assembly 102 and the second connector assembly 104 is a header assembly and may be referred to hereinafter as a header assembly 104. Other types of connector assemblies may be used in alternative embodiments, such as a vertical connector, a right angle connector or another type of connector. The subject matter described herein provides a pin spacer for any type of connector assembly, such as the receptacle assembly 102, the header assembly 104 or other types of connector assemblies.

The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a connector housing 120, which may be referred to hereinafter as a receptacle housing 120, that holds a plurality of contact modules 122. The contact modules 122 are held in a stacked configuration generally parallel to one another. Any number of contact modules 122 may be provided in the receptacle assembly 102. The contact modules 122 each include a plurality of signal contacts 124 (shown in FIG. 2) that define signal paths through the receptacle assembly 102.

The receptacle assembly 102 includes a front 128 defining a mating end (which may be referred to hereinafter as mating end 128) and a bottom 130 defining a mounting end 130 (which may be referred to hereinafter as bottom 130). The mating and mounting ends may be at different locations other than the front 128 and bottom 130 in alternative embodiments. The receptacle signal contacts 124 (shown in FIG. 2) are received in the receptacle housing 120 and held therein at the mating end 128 for electrical termination to the header assembly 104. The receptacle signal contacts 124 are arranged in a matrix of rows and columns. In the illustrated embodiment, at the mating end 128, the rows are oriented horizontally and the columns are oriented vertically. The receptacle signal contacts 124 within each column are provided within a respective same contact module 122. The receptacle signal contacts 124 within each row are provided in multiple contact modules 122. Other orientations are possible in alternative embodiments. Any number of receptacle signal contacts 124 may be provided in the rows and columns. Optionally, the receptacle signal contacts 124 may be arranged in pairs carrying differential signals. The receptacle signal contacts 124 extend through the receptacle assembly 102 from the mating end 128 to the mounting end 130 for mounting to the circuit board 106. Optionally, the mounting end 130 may be oriented substantially perpendicular to the mating end 128.

In an exemplary embodiment, each contact module 122 has a shield structure 126 for providing electrical shielding for the receptacle signal contacts 124. The contact modules 122 may generally provide 360° shielding for each pair of receptacle signal contacts 124 along substantially the entire length of the receptacle signal contacts 124 between the mounting end 130 and the mating end 128. In an exemplary embodiment, the shield structure 126 is electrically connected to the header assembly 104 and/or the circuit board 106. For example, the shield structure 126 may be electrically connected to the header assembly 104 by extensions (for example beams and/or fingers) extending from the contact modules 122 that engage the header assembly 104. The shield structure 126 may be electrically connected to the circuit board 106 by features, such as grounding pins. In an exemplary embodiment, a portion of the shield structure 126 on one side of the contact module 122 is electrically connected to a portion of the shield structure 126 on another side of the contact module 122. For example, portions of the shield structure 126 on opposite sides of the contact module 122 may be electrically connected to each other by internal extensions (for example tabs) that extend through the interior of the contact module 122. Having the portions of the shield structure 126 on opposite sides of the contact module 122 electrically connected to each other electrically commons the portions of the shield structure 126 to provide increased performance of the signal transmission through the contact module 122.

The receptacle housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header ground contacts 146 therein when the receptacle and header assemblies 102, 104 are mated. The ground contact openings 134 also receive the extensions (for example beams and/or fingers) of the shield structure 126 of the contact modules 122 that mate with the header ground contacts 146 to electrically common the receptacle and header assemblies 102, 104.

The receptacle housing 120 is manufactured from a dielectric material, such as a plastic material, and provides isolation between the signal contact openings 132 and the ground contact openings 134. The receptacle housing 120 isolates the receptacle signal contacts 124 and the header signal contacts 144 from the header ground contacts 146. The receptacle housing 120 isolates each set of receptacle and header signal contacts 124, 144 from other sets of receptacle and header signal contacts 124, 144.

The receptacle assembly 102 includes a pin spacer 136 coupled to the bottom of the receptacle assembly 102. The pin spacer 136 is used to hold the relative positions of the signal and grounding pins for mounting to the circuit board 106. The pin spacer 136 includes pin holes being spaced apart in an array corresponding to a particular pinout of vias in the circuit board 106 to which the receptacle assembly 102 is mounted. The pin spacer 136 is captured between the bottom of the receptacle assembly 102 and the circuit board 106 when the receptacle assembly 102 is mounted to the circuit board 106. In an exemplary embodiment, the pin spacer 136 includes features to protect the pins from damage during shipping and handling of the receptacle assembly prior to mounting to the circuit board 106.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The receptacle housing 120 engages the walls 140 to hold the receptacle assembly 102 in the chamber 142. The header signal contacts 144 and the header ground contacts 146 extend from a base wall 148 into the chamber 142 for mating with the receptacle assembly 102.

The header ground contacts 146 provide electrical shielding around corresponding header signal contacts 144. The header signal contacts 144 may be arranged in rows and columns on the header assembly 104. In an exemplary embodiment, the header signal contacts 144 are arranged in pairs configured to convey differential signals. The header ground contacts 146 peripherally surround a corresponding pair of the header signal contacts 144 to provide electrical shielding. In the illustrated embodiment, the header ground contacts 146 are C-shaped, covering three sides of the pair of header signal contacts 144.

Figure 2:
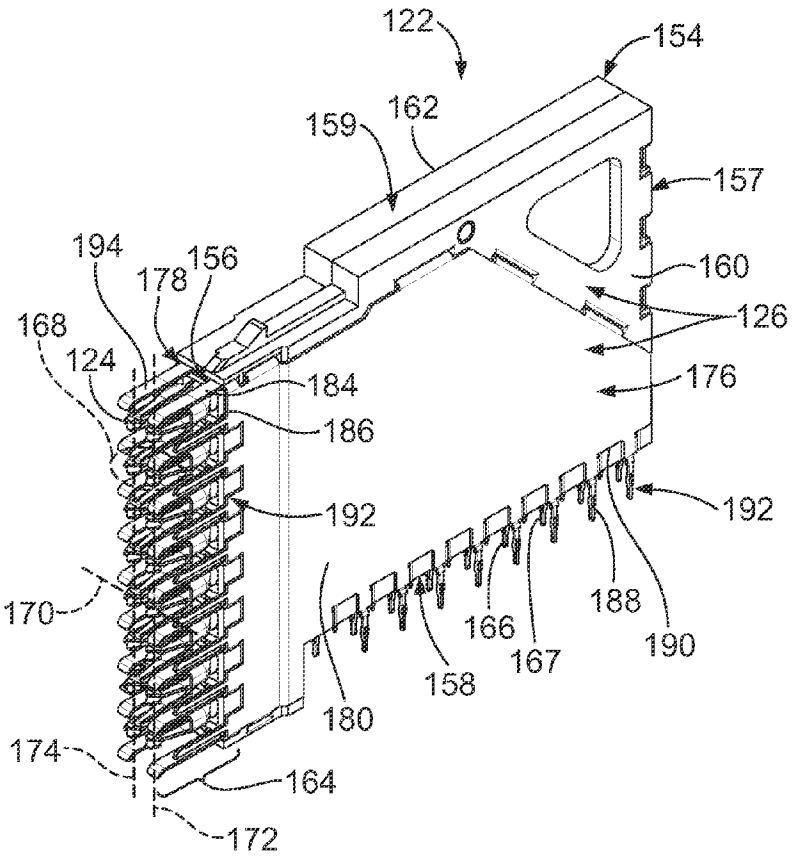
FIG. 2 is an exploded view of a connector assembly showing a contact module poised for loading into a housing.
Figure 2:
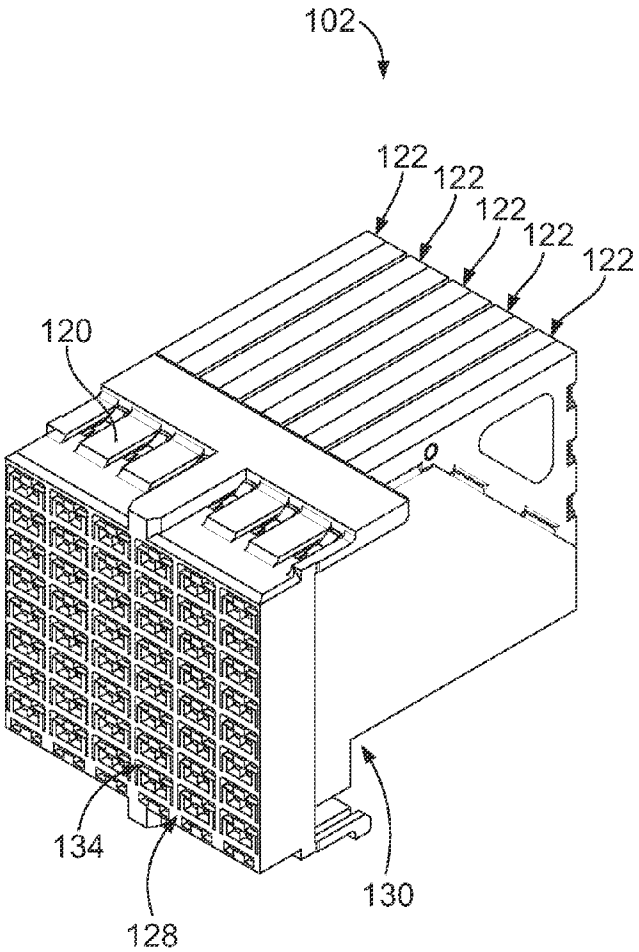
Figure 3:
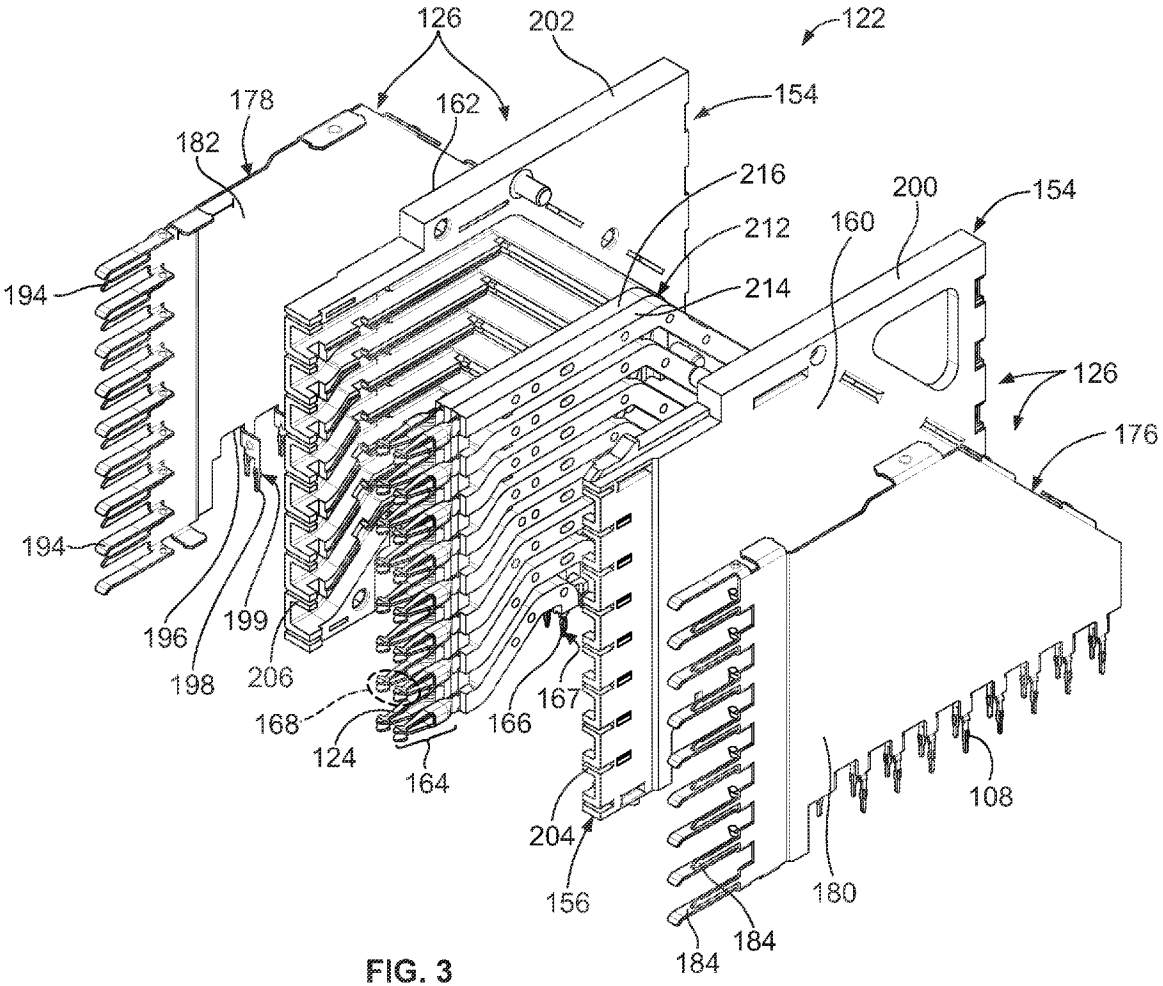
FIG. 3 is an exploded perspective view of the contact module shown in FIG. 2.

FIG. 2 is an exploded view of the receptacle assembly 102 showing one of the contact modules 122 poised for loading into the receptacle housing 120. FIG. 3 illustrates an exploded perspective view of the contact module 122. The contact modules 122 may be loaded side-by-side and parallel to each other in a stacked configuration. Six contact modules 122 are illustrated in FIG. 2, but any number of contact modules 122 may be used in alternative embodiments.

The contact module 122 includes a conductive holder 154 which defines at least a portion of the shield structure 126. The conductive holder 154 generally surrounds the receptacle signal contacts 124 along substantially the entire length of the receptacle signal contacts 124 between the mounting end 130 and the mating end 128. The conductive holder 154 has a front 156 configured to be loaded into the receptacle housing 120, a rear 157 opposite the front 156, a bottom 158 which optionally may be adjacent to the circuit board 106 (shown in FIG. 1), and a top 159 generally opposite the bottom 158. The bottom 158 of the conductive holder 154 defines a bottom of the contact module 122. The bottom 158 of the conductive holder 154 may define the bottom 130 of the receptacle assembly 102. The conductive holder 154 also defines right and left exterior sides 160, 162, as viewed from the front.

The conductive holder 154 is fabricated from a conductive material which provides electrical shielding for the receptacle assembly 102. For example, the conductive holder 154 may be die-cast, or alternatively stamped and formed, from a metal material. In other alternative embodiments, the holder 154 may be fabricated from a plastic material that has been metalized or coated with a metallic layer. In other embodiments, rather than a conductive holder, the holder 154 may be non-conductive. In other embodiments, the contact module 122 may be provided without the conductive holder 154 altogether.

The receptacle signal contacts 124 have mating portions 164 extending forward from the front 156 of the conductive holder 154. The mating portions 164 are configured to be electrically terminated to corresponding header signal contacts 144 (shown in FIG. 1) when the receptacle assembly 102 and header assembly 104 (shown in FIG. 1) are mated. In an exemplary embodiment, the other ends of the receptacle signal contacts 124 extend downward from the bottom 158 of the conductive holder 154 as signal pins 166 or simply pins 166. The signal pins 166 electrically connect the contact module 122 to the circuit board 106 (shown in FIG. 1). The signal pins 166 are configured to be terminated to the circuit board 106. For example, the signal pins 166 may be through-hole mounted to the circuit board 106. The signal pins 166 may be compliant pins, such as eye-of-the-needle pins. The signal pins 166 have enlarged areas 167 that are configured to engage corresponding plated vias of the circuit board 106 by an interference fit to mechanically and electrically couple the signal pins 166 to the circuit board 106. Optionally, in some embodiments, rather than being signal pins, at least some of the pins 166 may be grounding pins that are part of ground contacts. In an exemplary embodiment, the mating portions 164 extend generally perpendicular with respect to the signal pins 166.

In an exemplary embodiment, the receptacle signal contacts 124 in each contact module 122 are arranged as contact pairs 168 configured to transmit differential signals through the contact module 122. The receptacle signal contacts 124 within each contact pair 168 are arranged in rows that extend along row axes 170. In an exemplary embodiment, each row axis 170 includes one contact pair 168 from each contact module 122 stacked together in the receptacle assembly 102. At the mating end 128, the contact pairs 168 within each contact module 122 are stacked vertically. The right receptacle signal contacts 124 of each contact module 122 extend along a column axis 172, and the left receptacle signal contacts 124 of each contact module extend along a column axis 174. When the contact modules 122 are stacked in the receptacle assembly 102, the column axes 172, 174 of the contact modules 122 extend parallel to each other.

In an exemplary embodiment, each contact module 122 includes first and second ground shields 176, 178, which define at least a portion of the shield structure 126. The ground shields 176, 178 may be positioned along the exterior sides 160, 162 of the conductive holder 154. For example, the first ground shield 176 may be positioned along the right side 160 of the conductive holder 154, and as such, may be hereinafter referred to as the right ground shield 176. The second ground shield 178 (FIG. 3) may be positioned along the left side 162 of the conductive holder, and may be hereinafter referred to as the left ground shield 178. The ground shields 176, 178 are configured to provide electrical shielding for the receptacle signal contacts 124. The ground shields 176, 178 electrically connect the contact module 122 to the header ground contacts 146 (shown in FIG. 1), thereby electrically commoning the connection across the receptacle assembly 102 and header assembly 104 (shown in FIG. 1). Optionally, a single ground shield may be used rather than two ground shields. Alternatively, the contact module 122 may not include any ground shields.

The right ground shield 176 is coupled to the right exterior side 160 of the conductive holder 154. When attached to the conductive holder 154, the right ground shield 176 electrically connects to the conductive holder 154. The right ground shield 176 includes a main body 180 that is generally planar and extends alongside of the conductive holder 154. The ground shield 176 includes grounding beams 184 extending from a front 186 of the main body 180. The ground shield 176 includes grounding pins 188 extending from a bottom 190 of the main body. The grounding pins 188 are configured to be terminated to the circuit board 106 (shown in FIG. 1). For example, the grounding pins 188 may be through-hole mounted to the circuit board 106. The grounding pins 188 may be compliant pins, such as eye-of-the-needle pins. The grounding pins 188 have enlarged areas 192 that are configured to engage corresponding plated vias of the circuit board 106 by an interference fit to mechanically and electrically couple the grounding pins 188 to the circuit board 106.

The left ground shield 178 (FIG. 3) may be similar to the right ground shield 176. The left ground shield 178 may be a mirrored version of the right ground shield 176. The left ground shield 178 is coupled to the left exterior side 162 of the conductive holder 154. The left ground shield 178 includes a main body 182 that is generally planar and extends alongside of the conductive holder 154. The ground shield 178 includes grounding beams 194 extending from a front of the main body 182. The ground shield 178 includes grounding pins 198 extending from a bottom 196 of the main body. The grounding pins 198 are configured to be terminated to the circuit board 106 (shown in FIG. 1). For example, the grounding pins 198 may be through-hole mounted to the circuit board 106. The grounding pins 198 may be compliant pins, such as eye-of-the-needle pins. The grounding pins 198 have enlarged areas 199 that are configured to engage corresponding plated vias of the circuit board 106 by an interference fit to mechanically and electrically couple the grounding pins 198 to the circuit board 106.

In an exemplary embodiment, the right and left ground shields 176, 178 are manufactured from a metal material. The ground shields 176, 178 are stamped and formed parts with the grounding beams 184, 194 being stamped and then formed during a forming process. The grounding pins 188, 198 are stamped and/or formed.

The conductive holder 154 shown in the illustrated embodiment includes a right holder member 200 and a left holder member 202. Upon assembling the contact module 122, the right and left holder members 200, 202 are coupled together to form the conductive holder 154. The right and left ground shields 176, 178 are coupled to the right and left holder members 200, 202, respectively. The right ground shield 176 engages and is electrically connected to the right holder member 200. The left ground shield 178 (FIG. 3) engages and is electrically connected to the left holder member 202.

As a part of the shield structure 126, the holder members 200, 202 generally provide electrical shielding between and around respective receptacle signal contacts 124. For example, the holder members 200, 202 provide shielding from electromagnetic interference (EMI) and/or radio frequency interference (RFI), and may provide shielding from other types of interference as well. The holder members 200, 202 may provide shielding around the outside of the receptacle signal contacts 124 as well as between the receptacle signal contacts 124 using tabs 204, 206. As a result, the holder members 200, 202 allow for better control of electrical characteristics, such as impedance, cross-talk, and the like, of the receptacle signal contacts 124.

The conductive holder 154 holds a frame assembly 212, which includes the receptacle signal contacts 124. Upon assembly of the contact module 122, the frame assembly 212 is received in the right and left holder members 200, 202. The holder members 200, 202 provide shielding around the frame assembly 212 and receptacle signal contacts 124. The tabs 204, 206 are configured to extend into the frame assembly 212 such that the tabs 204, 206 are positioned between receptacle signal contact pairs 168 to provide shielding between adjacent contact pairs 168.

The frame assembly 212 includes a pair of right and left dielectric frames 214, 216, respectively, surrounding and supporting the receptacle signal contacts 124. In an exemplary embodiment, one of the receptacle signal contacts 124 of each contact pair 168 is held by the right dielectric frame 214, while the other receptacle signal contact 124 of the contact pair 168 is held by the left dielectric frame 216. The receptacle signal contacts 124 of each contact pair 168 extend through the frame assembly 212 generally along parallel paths such that the receptacle signal contacts 124 are skewless between the mating portions 164 and the signal pins 168.

In an exemplary embodiment, the receptacle signal contacts 124 are initially held together as leadframes (not shown), which are overmolded with dielectric material to form the dielectric frames 214, 216. Manufacturing processes other than overmolding a leadframe may be utilized to form the dielectric frames 214, 216, such as loading receptacle signal contacts 124 into a formed dielectric body.

Figure 4:
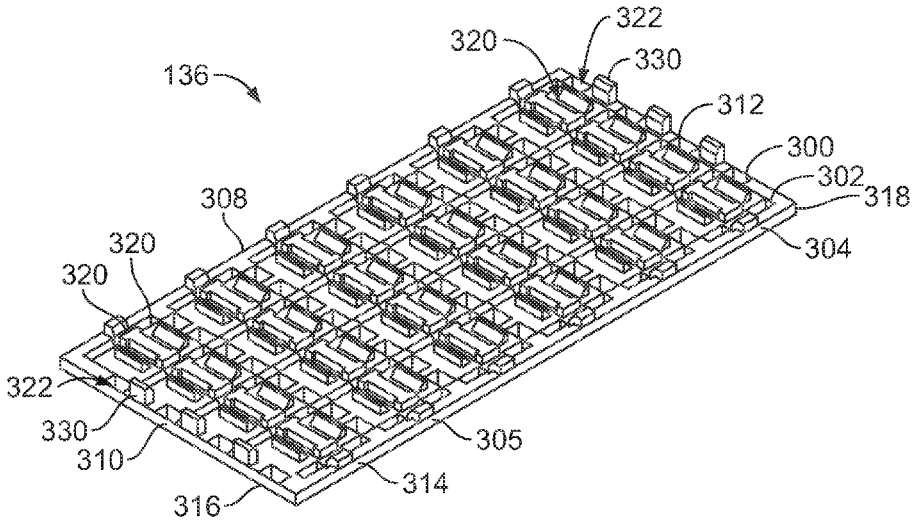
FIG. 4 is a perspective view of a pin spacer for the connector assembly formed in accordance with an exemplary embodiment.
Figure 5:
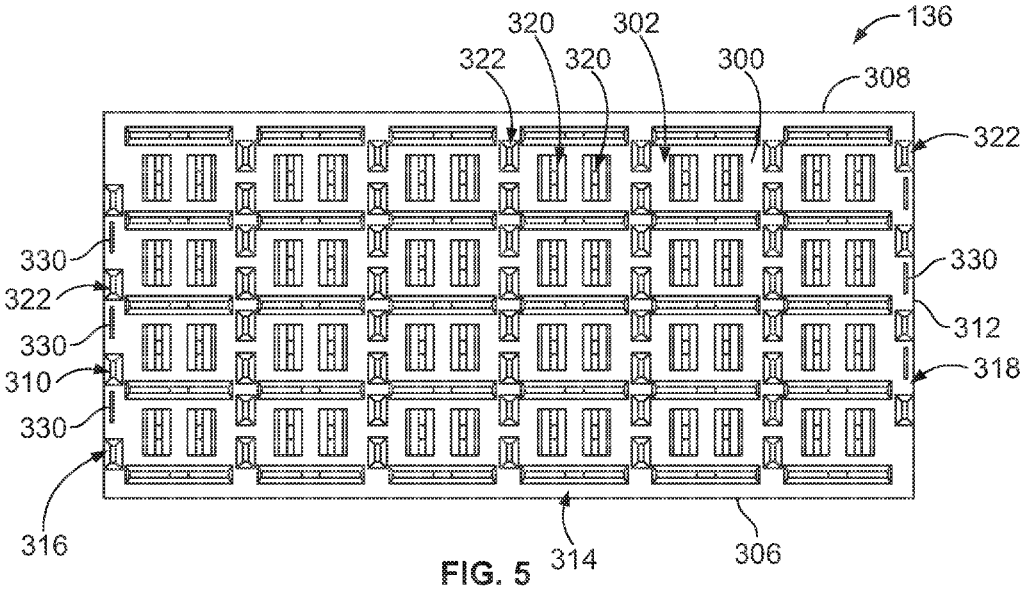
FIG. 5 is a top view of the pin spacer shown in FIG. 4.

FIG. 4 is a perspective view of the pin spacer 136 formed in accordance with an exemplary embodiment. FIG. 5 is a top view of the pin spacer 136. The pin spacer 136 includes a base or plate 300 having a top 302, bottom 304, front 306, rear 308 and opposite sides 310, 312. The pin spacer 136 includes edges 314 extending between the top 302 and the bottom 304 along the front 306, rear 308 and sides 310, 312. The edges 314 along the sides 310, 312 are identified as a first side edge 316 and a second side edge 318.

The pin spacer 136 includes a plurality of signal pin holes 320 and ground pin holes 322 extending through the plate 300 between the top 302 and bottom 304. The signal pin holes 320 receive corresponding signal pins 166 and the ground pin holes 322 receive corresponding grounding pins 188, 198 (shown in FIG. 2) of the receptacle assembly 102 (shown in FIG. 2). The pin holes 320, 322 are spaced apart in an array corresponding to a particular pinout of vias (not shown) in the circuit board 106 (shown in FIG. 1) to which the receptacle assembly 102 is mounted. The pin spacer 136 holds the positions of the pins 166, 188, 198 for mounting to the circuit board 106. The pins 166, 188, 198 are configured to extend through the pin holes 320, 322 beyond the bottom 304 of the pin spacer 136.

The pin spacer 136 includes a plurality of lugs 330 extending from the top 302 of the pin spacer 136. The lugs 330 are positioned proximate to the sides 310, 312 of the plate 300. The lugs 330 are used to protect the pins 166, 188, 198 from damage, such as during shipping, handling, mounting to the circuit board 106, and the like. The lugs 330 stop other components, such as other pin spacers 136 from passing above the pin spacer 136, which could potentially damage the pins 166, 188, 198. The lugs 330 are interspersed with pin holes 320 and/or 322 along the sides 310, 312 of the pin spacer 136. Optionally, the lugs 330 may be aligned in-column with the outer-most column of ground pin holes 322. In an exemplary embodiment, the lugs 330 along the first side 310 are staggered forward with respect to the lugs 330 along the second side 312 such that the lugs 330 at the opposite sides 310, 312 are in different rows.

Figure 6:
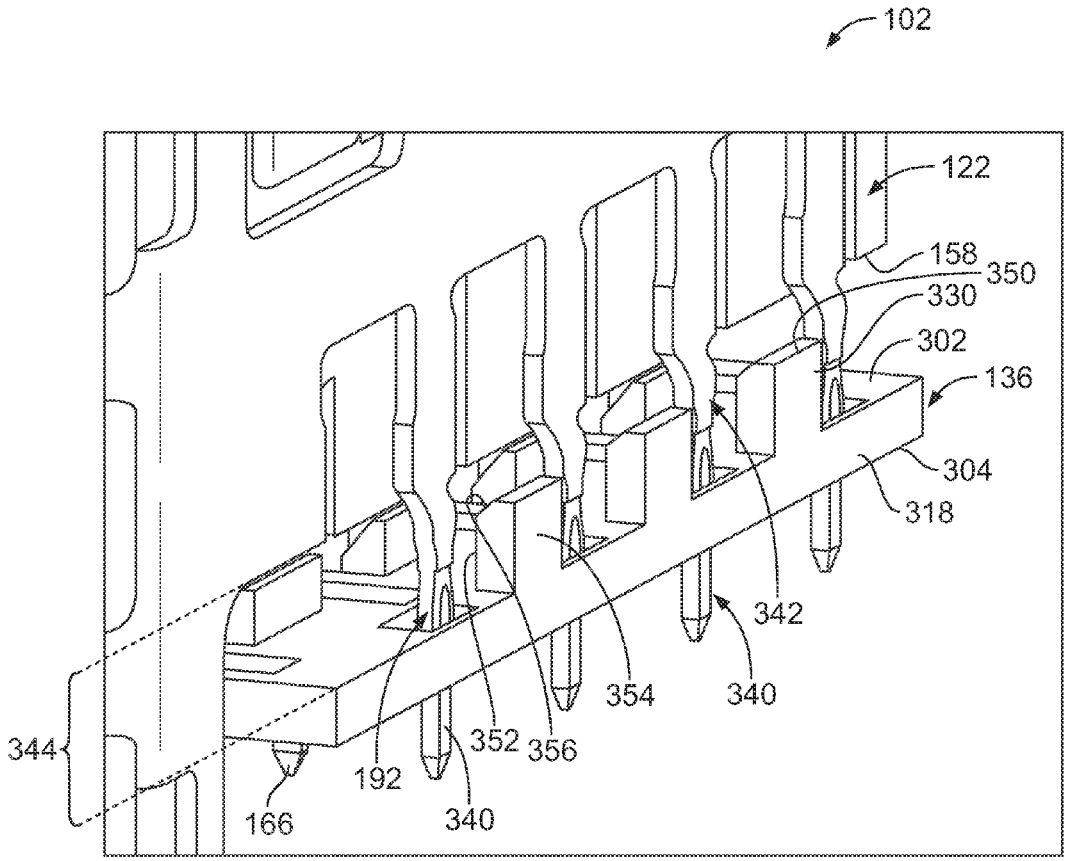
FIG. 6 illustrates a portion of the connector assembly showing the pin spacer coupled to the contact modules.

FIG. 6 illustrates a portion of the receptacle assembly 102, showing the pin spacer 136 coupled to the contact modules 122. The pin spacer 136 is loaded onto the bottom of the receptacle assembly 102 such that the signal pins 166 and the grounding pins 188, 198 (shown in FIG. 3) pass through the pin spacer 136 and are exposed below the bottom 304 for mounting to the circuit board 106 (shown in FIG. 1). In an exemplary embodiment, the pin spacer 136 is initially loaded onto the pins 166, 188, 198 to an intermediate position (FIG. 6). The pin spacer 136 is moved from the intermediate position to a fully loaded position (FIG. 1) where the pin spacer 136 abuts against the bottoms 158 of the contact modules 122. The intermediate position positions the pin spacer 136 further down the pins 166, 188, 198 to protect the pins, such as during shipping, handling and mounting to the circuit board 106. The pin spacer 136 is moved, for example pushed, to the fully loaded position as the receptacle assembly 102 is mounted to the circuit board 106. For example, as the pins 166, 188, 198 are loaded into the plated vias of the circuit board 106, the pin spacer 136 is eventually pushed against the circuit board 106 and further pushing of the receptacle assembly 102 in the loading direction pushes the pin spacer 136 to the fully loaded position (for example, upward on the pins 166, 188, 198).

In the intermediate position, the pin spacer 136 is only partially loaded onto the pins 166, 188, 198. For example, the pin spacer 136 is aligned with the enlarged areas 167, 192, 199 (shown in FIG. 2) of the pins 166, 188, 198. The pin spacer 136 may be held on the pins 166, 188, 198 by an interference fit between the compliant portions of the pins 166, 188, 198 at the enlarged areas 167, 192, 199. In the intermediate position, tips 340 of the pins 166, 188, 198 are exposed below the bottom 304 and stems 342 of the pins 166, 188, 198 are exposed above the top 302 of the pin spacer 136. In the intermediate position, the pin spacer 136 does not abut against the bottoms 158 of the contact modules 122. A space 344 is defined above the top 302 of the pin spacer 136 and the bottoms 158 of the contact modules 122. The space 344 is at least partially closed as the pin spacer 136 is moved to the fully loaded position.

The lugs 330 block entry into the space 344 defined between the bottoms 158 of the contact modules 122 and the top 302 of the pin spacer 136. The lugs 330 may span across a majority of the space 344. Optionally, the lugs 330 may span entirely across the space 344, such that the lugs 330 abut against the sides of the contact modules 122 in the intermediate position. The lugs 330 prevent damage to the pins 166, 188, 198, such as by blocking an adjacent pin spacer 136 from entering the space 344 to damage the stems 342 and/or by blocking the pin spacer 136 from moving to a position that could bend or damage pins of an adjacent receptacle assembly 102. The lugs 330 may block lateral (for example side-to-side) shifting of the pin spacer 136 relative to a pin spacer 136 of an adjacent receptacle assembly 102.

The lugs 330 extend to a tip 350. The lugs 330 have interior walls 352 and exterior walls 354 that extend to the tip 350. Optionally, the lugs 330 may have a chamfered surface 356 along the interior wall 352 to reduce stubbing when the pin spacer 136 is moved to the fully loaded position. The chamfered surface 356 guides the lug 330 into position along the side of the contact module 122. In the fully loaded position, the lugs 330 engage the sides of the outer-most contact modules 122. Optionally, the exterior walls 354 may be substantially aligned with the side edges 316, 318 (shown in FIG. 5) of the pin spacer 136 to provide a continuous wall or edge along the exterior of the pin spacer 136. Such continuous wall allows adjacent pin spacers 136 to ride alongside each other without catching, which could otherwise cause damage to the pins 166, 188, 198.

Figure 7:
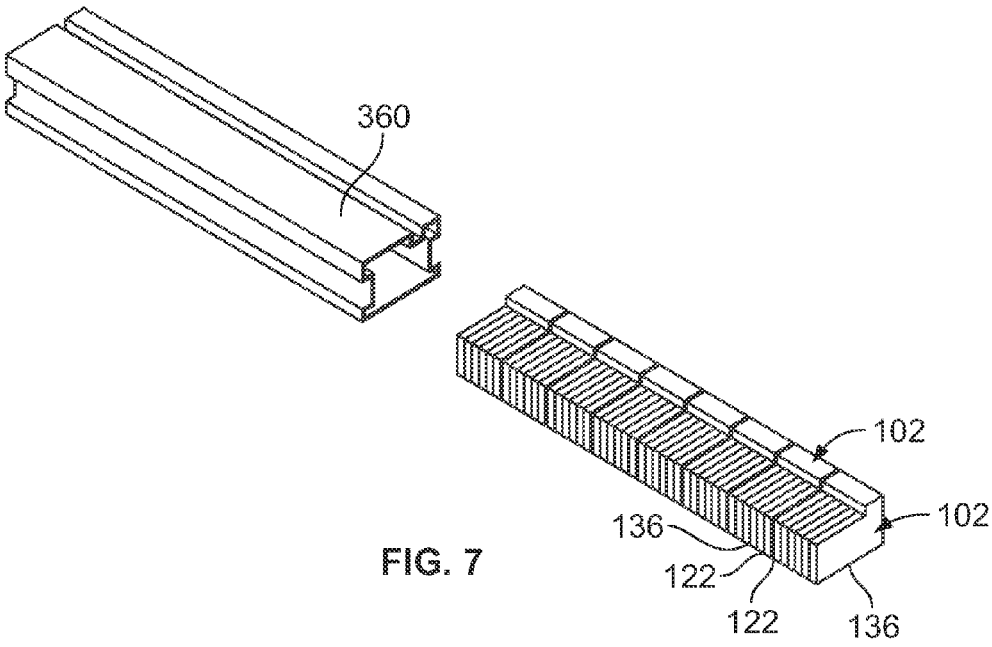
FIG. 7 illustrates a plurality of connector assemblies being loaded into a shipping tube.

FIG. 7 illustrates a plurality of receptacle assemblies 102 being loaded into a tube or container 360. The tube 360 is used for shipping or transport of the receptacle assemblies 102. The receptacle assemblies 102 are removed from the tube 360 at an assembly station or plant, where the receptacle assemblies 102 are assembled to the circuit board(s) 106 (shown in FIG. 1). Within the tube 360, the pin spacers 136 are preloaded to the intermediate position, which provides some protection for the otherwise exposed pins 166, 188, 198 (shown in FIG. 2). The tube 360 protects the receptacle assemblies 102 during transport or shipping. However, due to tolerances, the receptacle assemblies 102 may be able to move slightly within the tube 360. Without the lugs 330, the pin spacers 136 may shift up and/or down and side-to-side. For example, the pin spacer 136 of one receptacle assembly may shift upward and laterally to fit into the space 344 (shown in FIG. 6) between the bottom of the adjacent contact modules 122 and the top of the adjacent pin spacer 136. When such shifting occurs, the pins 166, 188, 198 of one or both receptacle assemblies 102 may be damaged, such as by being bent.

Figure 8:
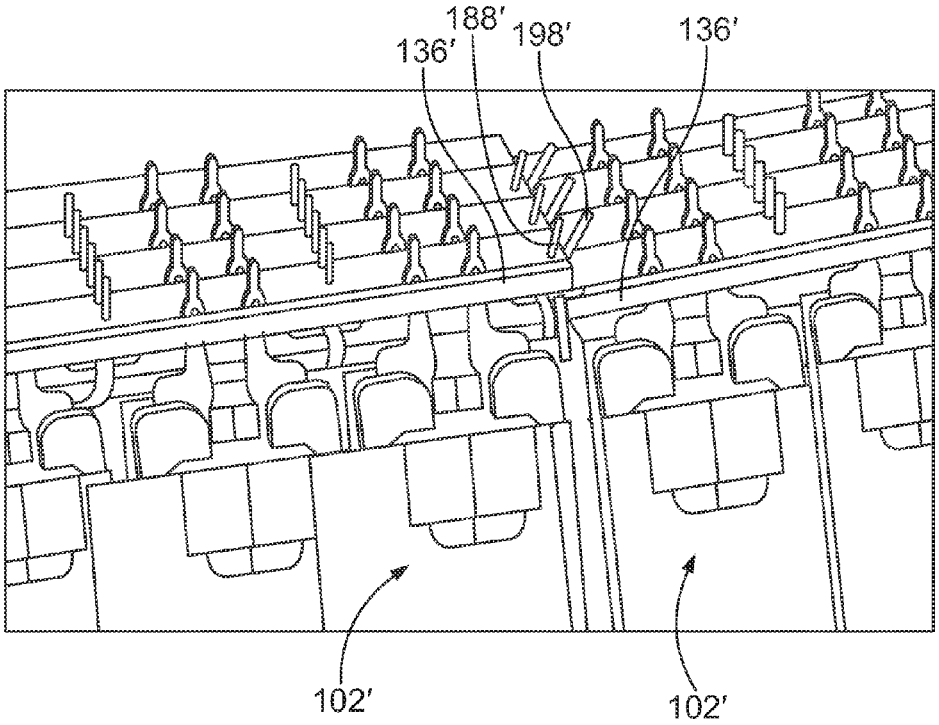
FIG. 8 illustrates portions of two conventional connector assemblies.

FIG. 8 illustrates portions of two conventional receptacle assemblies 102' that do not include lugs on the pin spacers 136' of the receptacle assemblies 102'. The pin spacers 136' have shifted and overlap each other, causing damage to the pins 188', 198', such as by bending the pins 188', 198'. Returning to FIG. 6, with the addition of the lugs 330 on the pin spacers 136 (of both adjacent pin spacers 136, only one being illustrated in FIG. 6), such lateral shifting that is problematic with the conventional receptacle assemblies (FIG. 8) is avoided.

Figure 9:
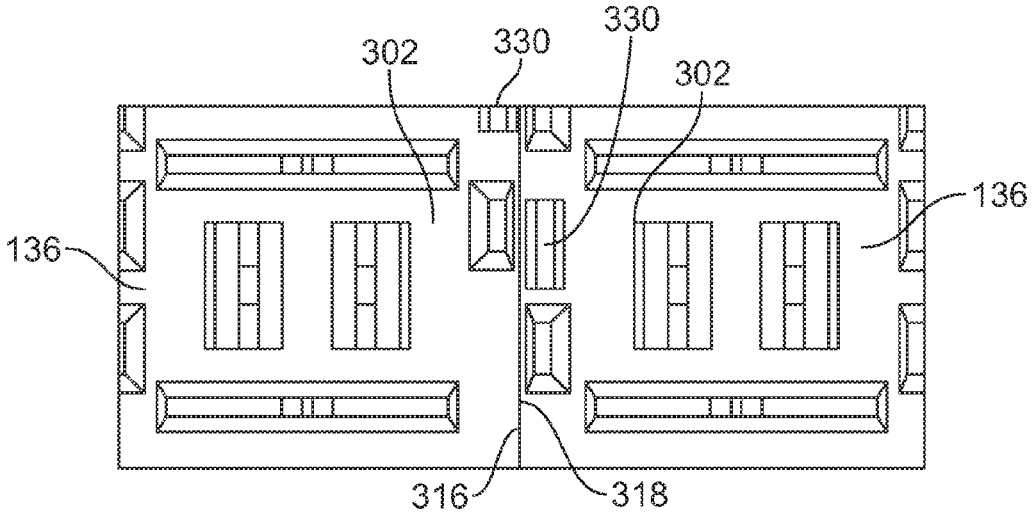
FIG. 9 is a top view of portions of two adjacent pin spacers shown in FIG. 4.

FIG. 9 is a top view of portions of two adjacent pin spacers 136 (which would be part of two receptacle assemblies, which may be adjacent one another within a tube for shipping). The lugs 330 extend from both pin spacers 136. In an exemplary embodiment, the lugs 330 of the adjacent pin spacers 136 are offset (for example front-to-rear offset). The pin spacers 136 are flush with the corresponding side edges 316, 318. If either of the pin spacers 136 shifts vertically within the tube, the lugs 330 prevent or block entry into the space 344 (shown in FIG. 6) above the top 302 of the corresponding pin spacer 136. The pin spacers 136 are unable to overlap one another because the lugs 330 prevent side-to-side lateral shifting of the pin spacers 136.

Figure 10:
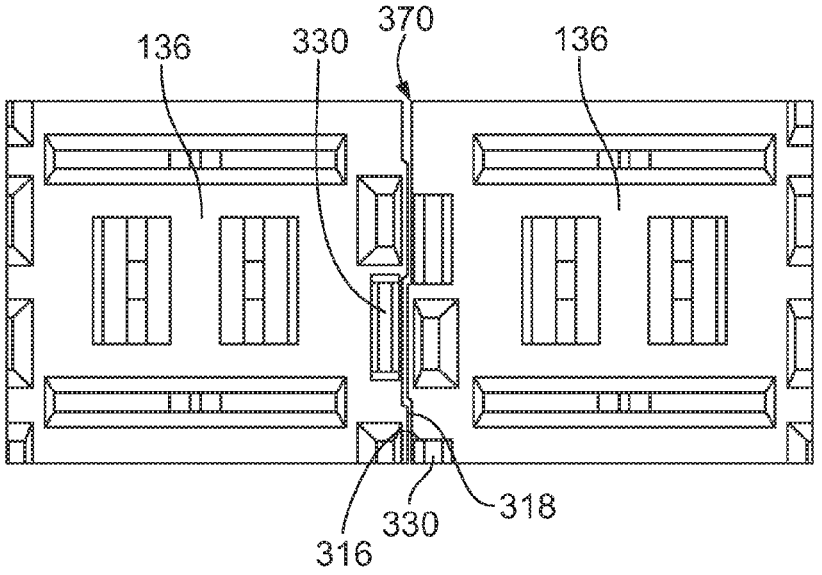
FIG. 10 is a top view of portions of two adjacent pin spacers formed in accordance with an exemplary embodiment.

FIG. 10 is another top view of portions of two adjacent pin spacers 136. The pin spacers 136 are substantially similar to the embodiment shown in FIG. 9, however the pins spacers 136 in FIG. 10 have scalloped or recessed side edges 316, 318. For example, the lugs 330 and portions of the side edges 316, 318 vertically aligned with the lugs 330 are shifted inward. The side edges 316, 318 are scalloped to internest with the adjacent pin spacer 136. Providing the scalloped side edges 316, 318 provides more clearance or tolerance between the pin spacers 136. The scalloped side edges 316, 318 may allow for tighter packaging of the receptacle assemblies 102. The scalloped side edges 316, 318 may allow a gap 370 to be present between the pin spacers 136. Such gap 370 allows room for the receptacle assemblies to float within the shipping tube.

Figure 11:
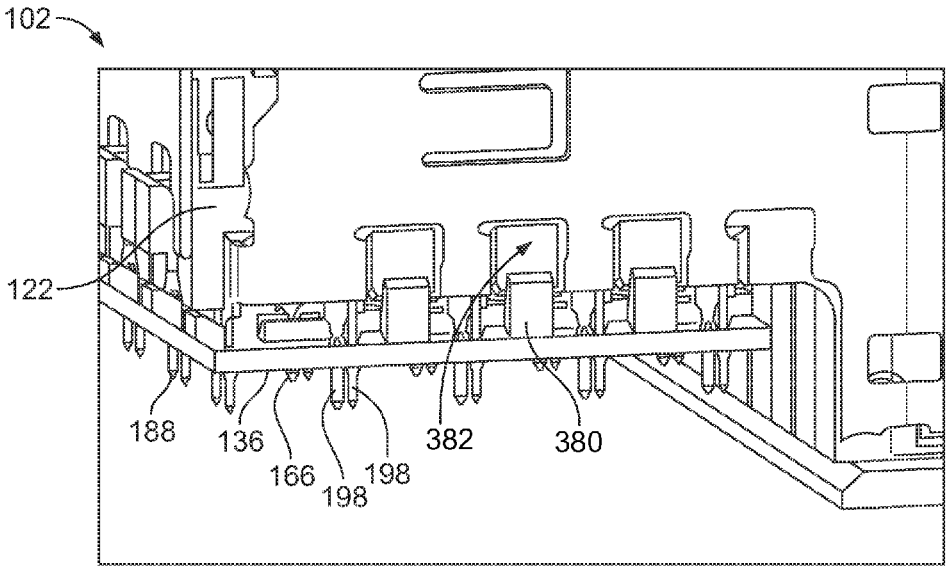
FIG. 11 is a side perspective view of the connector assembly showing an exemplary embodiment of a pin spacer.
Figure 12:
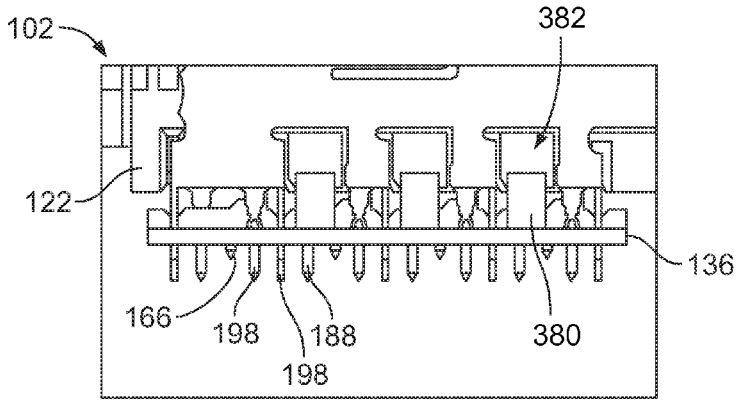
FIG. 12 is a side view of a portion of the connector assembly with the pin spacer shown in FIG. 11.

FIG. 11 is a side perspective view of the receptacle assembly 102 showing the pin spacer 136 with elongated or taller lugs 380 as compared to the embodiment shown in FIG. 6. FIG. 12 is a side view of a portion of the receptacle assembly with the embodiment of the pin spacer 136 shown in FIG. 11. The lugs 380 are elongated such that the lugs 380 engage the side of the outer-most contact module 122 when the pin spacer 136 is in the intermediate position (compared to FIG. 6 where the lugs are positioned vertically below the bottom of the contact module in the intermediate position). Having the elongated lugs 380 allows the pin spacer 136 to be more stable relative to the contact modules 122. For example, lateral forces exerted against the pin spacer 136, such as by an adjacent pin spacer 136, during shipping may be transferred to the contact module 122 as opposed to the pins 166, 188, 198. The pins 166, 188, 198 are less likely to be damaged when the pin spacer 136 is supported by or against the contact modules 122. However, the elongated lugs 380 may need to be thicker for mechanical stability. Such added thickness may be accounted for by undercutting or forming pockets 382 in the side of the contact module 122 to receive the lugs 380.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing;

a plurality of contact modules received in the housing, each contact module having a plurality of contacts, the contacts each including a pin for terminating to a circuit board, the pins extending from a bottom of the corresponding contact module; and a pin spacer coupled to the contact modules, the pin spacer having a plurality of pin holes extending through the pin spacer between a top of the pin spacer and a bottom of the pin spacer, the top of the pin spacer facing and being configured to engage the bottoms of the contact modules, the pin holes receiving corresponding pins for mounting to the circuit board, the pin spacer holding relative positions of the pins, the pin spacer having side edges at opposite sides of the pin spacer, the pin spacer having lugs extending from the top of the pin spacer proximate to the sides of the pin spacer beyond the top of the pin spacer, the lugs blocking entry of another pin spacer into a space defined between the bottoms of the contact modules and the top of the pin spacer.

2. The connector assembly of claim 1, wherein the lugs prevent damage to the pins.

3. The connector assembly of claim 1, wherein the lugs have exterior walls substantially aligned with the side edges of the pin spacer and have interior walls configured to extend along and engage outer sides of outermost contact modules.

4. The connector assembly of claim 1, wherein the lugs are interspersed with pin holes along the sides of the pin spacer.

5. The connector assembly of claim 1, wherein the pin spacer is initially held spaced apart from the bottoms of the contact modules on the pins to define the space between the bottoms of the contact modules and the top of the pin spacer, the lugs spanning across a majority of the space between the top of the pin spacer and the bottoms of the contact modules.

6. The connector assembly of claim 5, wherein the lugs span entirely across the space between the top of the pin spacer and the bottoms of the contact modules and engage the contact modules.

7. The connector assembly of claim 1, wherein the lugs block a pin spacer of an adjacent connector assembly from entering the space.

8. The connector assembly of claim 1, wherein the lugs block lateral shifting of the pin spacer relative to a pin spacer of an adjacent connector assembly.

9. The connector assembly of claim 1, wherein the opposite sides comprise a first side and a second side, the lugs along the first side being staggered forward with respect to the lugs along the second side.

10. The connector assembly of claim 9, wherein the connector assembly is configured to be positioned adjacent a second connector assembly, the lugs along the second side being staggered with respect to lugs along a first side of the second connector assembly.

11. The connector assembly of claim 1, wherein the sides are scalloped to internest with a pin spacer of an adjacent connector assembly.

12. The connector assembly of claim 1, wherein the lugs do not include any pin holes.

13. A connector assembly comprising:

a housing;

contact modules coupled to the housing, each contact module comprising:

a conductive holder holding a frame assembly, the frame assembly comprising a plurality of signal contacts and a dielectric frame supporting the signal contacts, the dielectric frame being received in the conductive holder, the signal contacts each including a signal pin for terminating to a circuit board, the signal pins extending from a bottom of the contact module; and a ground shield coupled to the conductive holder, the ground shield being electrically connected to the conductive holder, the ground shield having grounding pins extending beyond the bottom of the contact module for terminating to the circuit board; and a pin spacer coupled to the contact modules, the pin spacer having a plurality of signal pin holes and ground pin holes extending through the pin spacer between a top of the pin spacer and a bottom of the pin spacer, the top of the pin spacer facing and being configured to engage the bottoms of the contact modules, the signal pin holes receiving corresponding signal pins and the ground pin holes receiving corresponding grounding pins, the signal pins and grounding pins extending beyond the bottom of the pin spacer for mounting to the circuit board, the pin spacer holding relative positions of the signal pins and grounding pins, the pin spacer having side edges at opposite sides of the pin spacer, the pin spacer having lugs extending from the top of the pin spacer beyond the top of the pin spacer, the lugs blocking entry of another pin spacer into a space defined between the bottoms of the contact modules and the top of the pin spacer.

14. The electrical connector assembly of claim 13, wherein the lugs have exterior walls substantially aligned with the side edges of the pin spacer.

15. The electrical connector assembly of claim 13, wherein the lugs block a pin spacer of an adjacent connector assembly from entering the space.

16. The electrical connector assembly of claim 13, wherein the lugs block lateral shifting of the pin spacer relative to a pin spacer of an adjacent connector assembly.

17. A pin spacer for a connector assembly having a plurality of pins extending from a bottom of the connector assembly, the pin spacer comprising:

a plate having a top, a bottom, a front, a rear and opposite sides with edges extending between the top and bottom along the front, rear and sides, the top of the pin spacer being configured to engage the bottoms of the contact modules;

a plurality of pin holes extending through the plate between the top and bottom, the pin holes being configured to receive corresponding pins of the connector assembly, the pin holes being spaced apart in an array corresponding to a particular pinout of vias in a circuit board to which the connector assembly is mounted; and lugs extending from the top beyond the top of the pin spacer, the lugs being positioned proximate to the sides of the plate, the lugs blocking entry of another pin spacer into a space defined above the top of the plate from the sides of the plate.

18. The pin spacer of claim 17, wherein the lugs have exterior walls substantially aligned with the side edges of the pin spacer.

19. The pin spacer of claim 17, wherein the lugs are interspersed with pin holes along the sides of the pin spacer.

20. The pin spacer of claim 17, wherein the lugs block a pin spacer of an adjacent connector assembly from overlapping over the top of the pin spacer.

* * * * *